US009418627B2

(12) United States Patent
Davis

(10) Patent No.: US 9,418,627 B2
(45) Date of Patent: Aug. 16, 2016

(54) INFLATABLE DISPLAY DEVICE

(71) Applicant: TAIT TOWERS MANUFACTURING, LLC, Lititz, PA (US)

(72) Inventor: Adam Davis, Leola, PA (US)

(73) Assignee: Tait Towers Manufacturing LLC, Lititz, PA (US)

( * ) Notice: Subject to any disclaimer, the term of this patent is extended or adjusted under 35 U.S.C. 154(b) by 241 days.

(21) Appl. No.: 14/049,787

(22) Filed: Oct. 9, 2013

(65) Prior Publication Data

US 2015/0097761 A1 Apr. 9, 2015

(51) Int. Cl.

| | |
|---|---|
| ***A63G 31/12*** | (2006.01) |
| ***G09G 5/36*** | (2006.01) |
| ***F21V 33/00*** | (2006.01) |
| ***F21V 3/02*** | (2006.01) |
| *A63H 27/10* | (2006.01) |
| *F21W 121/00* | (2006.01) |
| *F21Y 101/02* | (2006.01) |

(52) U.S. Cl.

CPC *G09G 5/36* (2013.01); *A63G 31/12* (2013.01); *F21V 3/026* (2013.01); *F21V 33/00* (2013.01); *A63H 2027/1058* (2013.01); *F21W 2121/00* (2013.01); *F21Y 2101/02* (2013.01)

(58) Field of Classification Search

CPC ..... A63H 2027/1058; A63H 27/10; A63H 2027/1075; A63H 3/06; E04H 15/20; F21S 4/001; F21S 6/00; F21V 3/023; F21V 3/026; F21V 23/00; F21V 21/08; F21V 5/002; F21W 2121/00; F21Y 2101/02; G09F 27/007; G09F 21/10; G09F 21/14; H01Q 15/163; Y10S 116/09; Y10S 362/812

USPC ..... 362/249.01, 249.02, 249.04, 249.08, 362/249.14, 249.16–249.19, 311.01, 362/311.13, 653, 811, 812; 40/214, 540; 446/220

See application file for complete search history.

(56) References Cited

U.S. PATENT DOCUMENTS

| | | | | |
|---|---|---|---|---|
| 2,557,383 A * | 6/1951 | Kerwer | G09F 21/10 116/DIG. 9 |
| 3,670,440 A | 6/1972 | Yost | |
| 4,179,832 A * | 12/1979 | Lemelson | 40/540 |
| 5,888,156 A * | 3/1999 | Cmiel | A63B 43/06 473/570 |
| 5,947,581 A * | 9/1999 | Schrimmer | A63H 27/10 362/189 |
| 6,390,651 B2 * | 5/2002 | Bertrand | A63H 27/10 362/101 |

(Continued)

*Primary Examiner* — Hargobind S Sawhney

(74) *Attorney, Agent, or Firm* — McNees Wallace & Nurick LLC

(57) ABSTRACT

An inflatable display device is provided. The inflatable display device includes an inflatable support device, and a plurality of illumination sources, each of the illumination sources secured to the inflatable support device. The illumination sources are arranged in a preconfigured pattern on the inflatable support device, the preconfigured pattern resulting in the appearance of a continuous display. Another inflatable display device includes a cast silicon material, and a plurality of illumination sources, the illumination sources positioned within the cast silicon material. The cast silicon material forms an inflatable structure having a predetermined three dimensional configuration. Another inflatable display device includes an inflatable support device, a plurality of illumination sources, each of the illumination sources secured to the inflatable support device, and a control system coupled to the illumination sources. The control system coordinates operation of the plurality of illumination sources to form the appearance of a continuous display.

28 Claims, 4 Drawing Sheets

(56) References Cited

U.S. PATENT DOCUMENTS 8,356,926 B1 * 1/2013 Sanders ..... 362/653
8,550,663 B2 * 10/2013 Tong ..... 362/249.16
2006/0037225 A1 2/2006 Wei
2006/0291217 A1 12/2006 Vanderschuit
2008/0032589 A1 * 2/2008 Sun ..... 446/220
2009/0107020 A1 4/2009 Aires

* cited by examiner

INFLATABLE DISPLAY DEVICE

FIELD OF THE DISCLOSURE

The present disclosure relates to inflatable display devices. More specifically, the present disclosure relates to inflatable light emitting diode display devices.

BACKGROUND OF THE DISCLOSURE

Display systems, such as those used in venues for public performance, often require disassembly, transportation, and reassembly between each performance. The disassembly, transportation and reassembly can be expensive, complicated and time consuming. One method of addressing these concerns includes the use of an inflatable support structure.

Inflatable objects can be quickly inflated and/or deflated to form a support structure. Many support structures formed by inflatable objects are used to support a separate display screen. The separate display screen must be positioned on the inflatable support structure after inflation, and removed from the inflatable support structure prior to deflation. The inflatable support structure can be unstable, requires set-up beyond inflation, and cannot form a display screen having the geometrical configuration of the inflatable objects.

In addition to supporting separate display screens, the inflatable objects have supported strings of lights, both internally and externally. The lights may illuminate the inflatable objects from within, or flash in a predetermined manner to form a light display. However, the strings of lights do not form display screens capable of showing videos, and do not form display screens having the geometrical configuration of the inflatable objects.

Therefore, there is an unmet need to provide inflatable, transportable visual displays capable of forming a preconfigured shape, functioning as a light source, and as a video display. Such abilities either alone or in combination can provide an intriguing, highly entertaining visual experience, while at the same time being increasingly easy to disassemble and transport.

SUMMARY OF THE DISCLOSURE

One aspect of the disclosure refers to an inflatable display device including an inflatable support device and a plurality of illumination sources, each of the illumination sources secured to the inflatable support device. The illumination sources are arranged in a preconfigured pattern on the inflatable support device, the preconfigured pattern resulting in the appearance of a continuous display.

Another aspect of the disclosure refers to an inflatable display device including a cast silicon material and a plurality of illumination sources, the illumination sources positioned within the case silicon material. The cast silicon material forms an inflatable structure having a predetermined three dimensional configuration. The illumination sources in the predetermined three dimensional configuration form the appearance of a continuous display.

Another aspect of the disclosure refers to an inflatable display device including an inflatable support device, a plurality of illumination sources, each of the illumination sources secured to the inflatable support device, and a control system coupled to the illumination sources. The control system coordinates operation of the plurality of illumination sources to form the appearance of a continuous display.

An advantage of the present disclosure is that the inflatable display device provides a transportable display having a decreased set-up and removal time.

Another advantage of the present disclosure is that the plurality of illumination sources remain attached to a deflated inflatable display device.

Yet another advantage of the present disclosure is that the inflatable display device provides a three dimensional display that produces video.

Yet another advantage of the present disclosure is that the inflatable display device provides a video screen upon inflation, without further set-up.

Further aspects of the method and system are disclosed herein. The features as discussed above, as well as other features and advantages of the present disclosure will be appreciated and understood by those skilled in the art from the following detailed description and drawings.

BRIEF DESCRIPTION OF THE DRAWINGS

Wherever possible, the same reference numbers will be used throughout the drawings to represent the same parts.

DESCRIPTION OF THE DISCLOSURE

Provided is an exemplary inflatable display device. Embodiment of the present disclosure, in comparison to devices not using one or more of the features disclosed herein, reduce set-up time, reduce removal time, permit the reduction or elimination of the need for vertical supports within display device thereby significantly reducing the weight of the overall system, permit assembly by personnel having little or no technical skill, increase ease of storage, increase ease of transportation, or a combination thereof.

Figure 1:
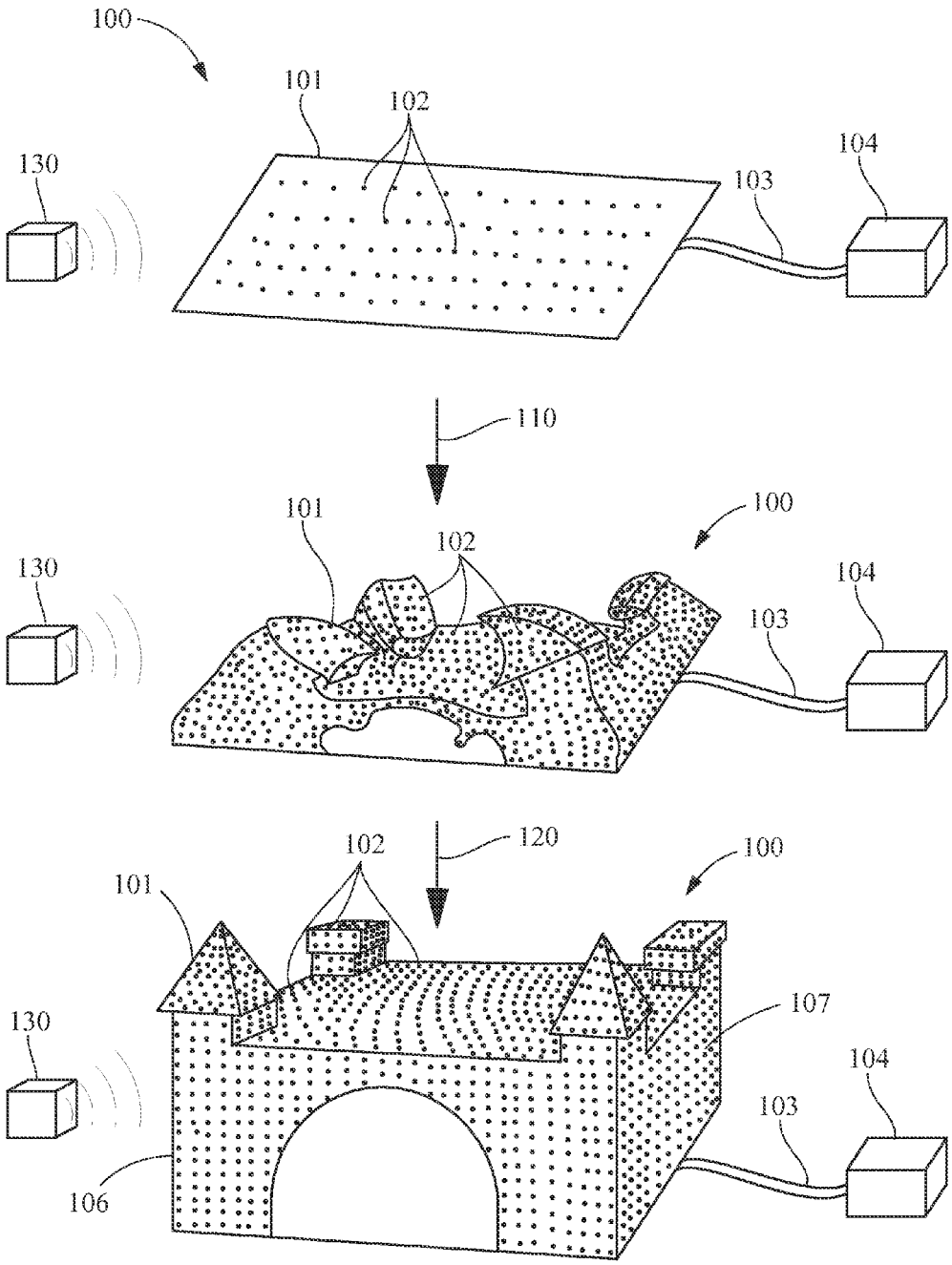
FIG. 1 shows inflation of an inflatable display device according to an embodiment of the disclosure.

Referring to FIG. 1, in one embodiment, an inflatable display device 100 includes a plurality of flexible illumination sources 102 secured to an inflatable support structure 101. Flexible, as used herein, refers to an ability of the illumination sources 102 to independently move relative to each other. The illumination sources 102 remain secured to the inflatable support structure 101 throughout an inflation and/or deflation of the inflatable display device 100. The illumination source 102 is any suitable illumination source capable of producing a plurality of colors and/or intensities. Suitable illumination sources 102 include, but are not limited to, one or more LEDs, organic light emitting diode OLEDs, incandescent bulbs, fluorescent bulbs, polymer light emitting diodes, electroluminescent lights, other suitable illuminating or light emitting sources, or a combination thereof.

A hose 103 couples the inflatable support structure 101 to a pump 104, the pump 104 inflating and/or deflating the inflatable display device 100. The pump 104 directs a gas (step 110) to an interior portion 403 (FIG. 4) of the inflatable support structure 101. The gas is any suitable gas capable of inflating an object. Suitable gasses include, but are not limited to, oxygen, nitrogen, helium, air, or a combination thereof. The gas fills the interior portion 403 of the inflatable support structure 101, expanding the inflatable support structure 101 in the X, Y and Z planes. An amount of the gas is maintained (step 120) within the inflatable support structure 101, forming the inflatable display device 100 having a three dimensional shape.

A video screen in the three dimensional shape of the inflatable support structure 101 is formed by the illumination sources 102 secured to the inflated inflatable support structure 101. In one embodiment, the inflatable support structure 101 is inflated and immediately ready to provide video images (video). For example, the deflated inflatable support structure 101 is positioned prior to the start of a performance, inflated during the performance and provides the video immediately upon inflation. The integral illumination sources 102 eliminate a need for post-inflation set-up, providing for control of the inflatable display device from a remote position.

In one embodiment, the illumination sources 102 are connected by electrical and/or control wires 202 (wires) or other connectors or wireless connections. In one embodiment, the illumination sources 102 are connected to each other in a grid pattern of the wires 202. The wires 202 are connected to the illumination sources 102 by any suitable technique or connector. In one embodiment, the wires 202 are arranged in conjunction with a flexible support to provide selective distribution of weight of the inflatable display device 100. In one embodiment, the wires 202 provide the flexible support for the illumination sources 102. In one embodiment, the illumination sources 102 are connected with wires 202 that are fiber-optic cables permitting the light to be emitted from various sources. In another embodiment, the wires 202 may be translucent, transparent, semi-transparent, semi-translucent, semi-opaque, opaque, or combinations thereof.

In one embodiment, the illumination sources 102 are wirelessly connected. The wireless connections provide wireless control and/or wireless power to the illumination sources 102 from a remote location. Utilizing wireless control and/or wireless power reduces weight and increases portability. In one embodiment, the wirelessly connected illumination sources 102 are powered by individual batteries housed with light emitting diodes (LEDs) or other light sources. Another embodiment includes organic light emitting diodes (OLEDs) as LEDs. OLEDs reduce power requirements and permit longer operation on the same charge. Additionally, OLEDs permit the inflatable display device 100 to run on the same charge for an increased period of time as compared to LEDs.

A control panel 130 is coupled to the illumination sources 102, providing power and/or coordinating operation. In one embodiment, the control panel 130 is remote to the inflatable display device 100 and/or integrated into controls of a theatrical performance. In another embodiment the control panel 130 is wirelessly connected to the inflatable display device 100. In one embodiment, the control panel 130 is electrically connected to the display device 100 thereby permitting power and/or signals to travel to the illumination sources 102.

The inflatable display device 100 includes a plurality of the illumination sources 102 arranged and disposed in a preconfigured pattern to form a suitable continuous display. Suitable continuous displays include, but are not limited to, an illusion of a continuous image (for example, when viewed from a typical viewing distance within a venue), a three-dimensional image, a landscape image, a portrait image, a text image, a text string image, moving image, video, dynamic visual effect, or a combination thereof.

The continuous display on the inflatable display device 100 is coordinated by the control panel 130, which varies the colors and intensities of the illumination sources 102. A suitable control panel 130 includes any suitable control means (not shown) known in the art for providing images and/or video. The control panel 130 coordinates adjacent illumination sources 102 to form an illuminated image emanating from the inflatable support structure 101. The illuminated image is controlled in real time to produce the video. The real time control of the video image reduces or eliminates preprogramming of a display prior to an event.

In one embodiment, the illumination sources 102, such as LEDs (not shown), are closely spaced thereby creating a high resolution image, series of images, and/or video. Video, as used herein, refers to the movement of visual images. Decreasing the number of the illumination sources 102 and/or increasing the space between adjacent illumination sources 102 decreases the resolution of the display screen 100. In one embodiment, each illumination source 102 is an LED pixel. The plurality of illumination sources 102 forms a low resolution video screen.

Figure 2:
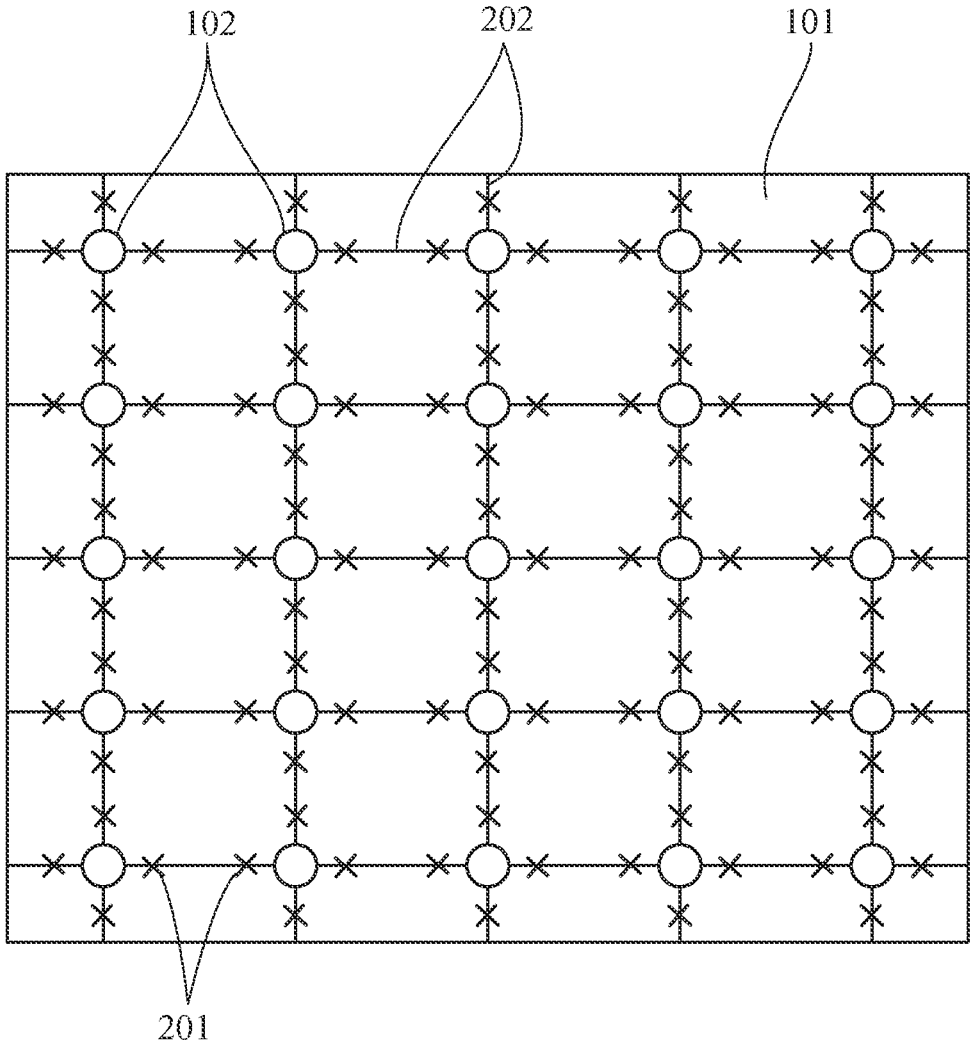
FIG. 2 is an enlarged section of an inflatable display device according to an embodiment of the disclosure.
Figure 4:
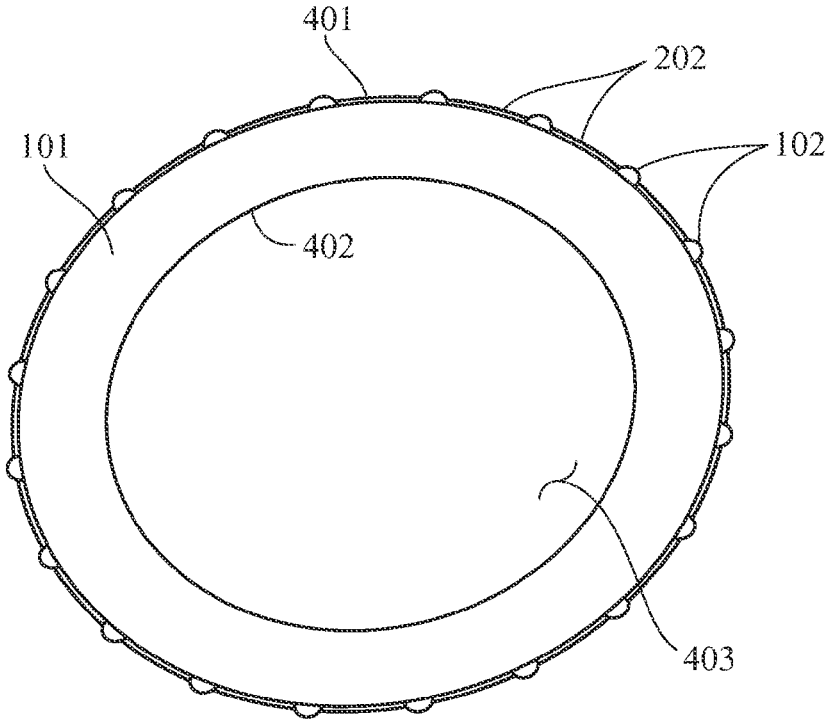
FIG. 4 is a cross-sectional view of an inflatable display device according to the inflatable display device of FIG. 2.

Referring to FIG. 2 and FIG. 4, in one embodiment, the plurality of illumination sources 102 are secured to the exterior surface 401 of the inflatable support structure 101. In one embodiment, the plurality of illumination sources 102 are sewn to the exterior surface 401 with stitches 201. The stitches 201 secure the illumination sources 102 without puncturing the interior surface 402 and/or allowing the gas within the interior portion 403 of the inflatable support structure 101 to escape. The stitches 201 are placed such that they do not inhibit the inflatable support structure 101 from contracting or expanding during inflation or deflation.

Figure 3:
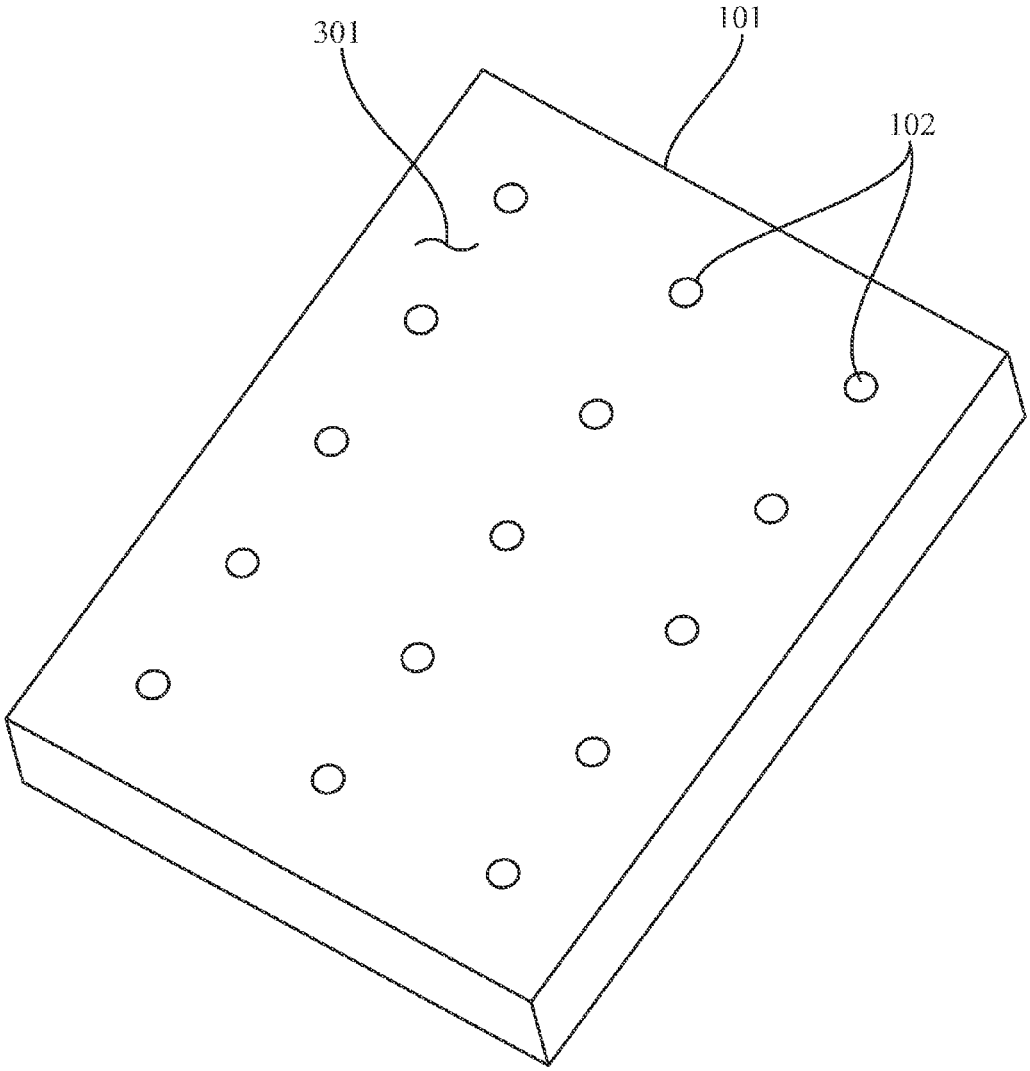
FIG. 3 is an enlarged section of an inflatable display device according to an embodiment of the disclosure.
Figure 5:
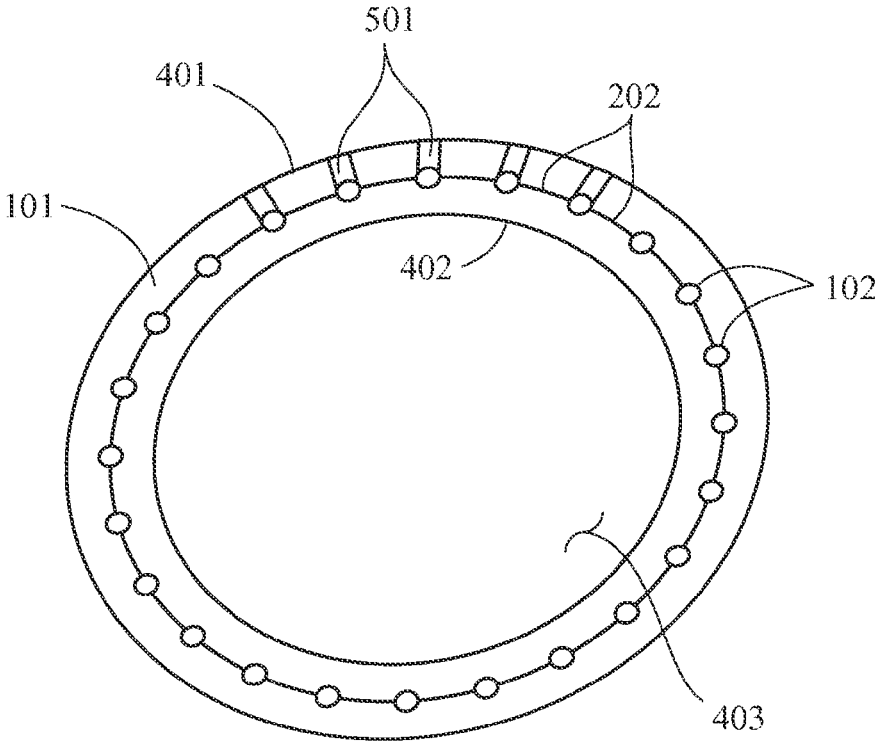
FIG. 5 is a cross-sectional view of an inflatable display device according to the inflatable display device of FIG. 3.

Referring to FIG. 3 and FIG. 5, in one embodiment, the illumination sources 102 are positioned within the exterior surface 401 of the inflatable support structure 101, proximal to the interior portion 403. Suitable attachment of the illumination sources 102 on the inside of the inflatable support structure 101 includes, but is not limited to, sewing, gluing, encapsulating, casting, or a combination thereof. In a further embodiment, the illumination sources 102 are positioned between the exterior surface 401 and the interior surface 402 of the inflatable support structure 101. In one embodiment, the inflatable support structure 101 includes a transparent or semi-transparent material through which the illumination sources 102 are seen. In one embodiment, the inflatable support structure 101 includes illumination openings 501 through which the illumination sources 102 shine. The illumination openings 501 associated with each of the illumination sources 102 are sized differently from, or similar to, each of the other illumination openings.

A suitable inflatable support structure 101 for containing the illumination sources 102 includes a cast silicon material 301. The cast silicon material 301 encapsulates the plurality of illumination sources 102, securing the illumination sources 102 within the inflatable support structure 101. The cast silicon material 301 secures the plurality of illumination sources 102 within the inflatable support structure 101 throughout inflation and/or deflation. Additionally, the cast silicon material 301 protects the plurality of illumination sources 102 from damage such as, but not limited to, incidental contact, storage, transportation, moisture, weather, or a combination thereof.

The inflatable support structure 101 is deflated to increase ease of storage and transportation. The pump 104 reverses a flow of gas through the hose 103 to remove the gas from within the interior portion 403 of the inflatable support structure 101. Removing the gas from within the interior portion 403 of the inflatable support structure 101 deflates the inflatable support structure 101, reducing its volume. In one embodiment, the inflatable support structure 101 folds in a predetermined manner throughout deflation. The deflated inflatable support structure 101 has increased portability and ease of storage.

In one embodiment, the inflatable support structure 101 includes an integral storage and/or transportation apparatus. The integral storage and/or transportation apparatus contains the deflated inflatable support structure 101 and forms a base for the inflated inflatable support structure 101. For example, in one embodiment, the integral storage and/or transportation apparatus is a cube having pivotable panels secured there to. The panels are lowered to form a base for the inflatable display device 100, and raised to enclose the inflatable display device 100 during storage and transportation.

In one embodiment, at least a portion of the exterior surface 401 is substantially planar. In another embodiment, at least a portion of the exterior surface 401 is substantially non-planar. Portions of the exterior surface 401 have features that involve different visual effects, such as opacity, translucence, reflection, diffusion, transparency, or a combination thereof. Diffusion is intended to include prismatic diffusion of light into the visible spectrum, as required to achieve a desirable visual effect.

In one embodiment, the inflatable support structure 101 includes multiple portions. For example, referring to FIG. 1, in one embodiment the inflatable support structure 101 includes a top portion 105, a first side portion 106 and a second side portion 107. The top portion 105, the first side portion 106, and the second side portion 107 are secured to each other, forming the inflatable display device 100. The portions are secured using any suitable securing means, such as, but not limited to interlocking features, clipping members, magnets, wire, rope, fasteners, or a combination thereof. In one embodiment, the single structure includes one or more openings for the gas and is inflated with one or more of the pumps 104.

In another embodiment, the top portion 105, the first side portion 106 and the second side portion 107 are separate and detachable from each other. Each portion includes one or more openings for the gas, and is individually inflatable. In one embodiment, the openings of multiple portions are coupled to form the inflatable support structure 101 having a continuous interior portion 403 between the top portion 105, the first side portion 106 and the second side portion 107. In one embodiment, the top portion 105 is secured to the first side portion 106 and the second side portion 107, and the interior portion 403 of each portion remains separate from other portions. In another embodiment, the individual portions are secured to each other prior to inflation. In another embodiment the individual portions are inflated prior to being secured to each other.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. An inflatable display device comprising:

a cast silicon material; and a plurality of illumination sources, the illumination sources positioned within the cast silicon material;

wherein the cast silicon material forms an inflatable structure having a predetermined three dimensional configuration; and wherein the illumination sources in the predetermined three dimensional configuration form the appearance of a continuous display.

2. The inflatable display device of claim 1, wherein the cast silicon material is substantially transparent.

3. The inflatable display device of claim 1, wherein the illumination sources comprise light emitting diodes.

4. The inflatable display device of claim 1, wherein a light produced by the light emitting diodes is displayed through the cast silicon material.

5. The inflatable display device of claim 1, wherein the cast silicon material shield the plurality of illumination sources from damage.

6. The inflatable display device of claim 1, wherein the cast silicon material increases a weather resistance of the plurality of illumination sources.

7. An inflatable display device comprising:

an inflatable support device including a cast silicone material; and a plurality of illumination sources, each of the illumination sources secured to a surface of the inflatable support device;

wherein each of the illumination sources is positioned between an interior surface and an exterior surface of the inflatable support device;

wherein the illumination sources are arranged in a preconfigured pattern on the inflatable support device, the preconfigured pattern resulting in the appearance of a continuous display.

8. The inflatable display device of claim 7, wherein the illumination sources comprise flexible light emitting diodes.

9. The inflatable display device of claim 8, wherein the flexible light emitting diodes produce a plurality of colors.

10. The inflatable display device of claim 8, wherein the flexible light emitting diode illumination sources are movable relative to each other.

11. The inflatable display device of claim 7, wherein inflating the inflatable display device forms a predetermined three dimensional structure.

12. The inflatable display device of claim 7, comprising deflating the inflatable display device to decrease a size of the inflatable display device.

13. The inflatable display device of claim 7, wherein the plurality of illumination sources remain secured to the deflated inflatable display device.

14. The inflatable display device of claim 7, wherein the continuous display provides a continuous image selected from the group consisting of, a three-dimensional image, a landscape image, a portrait image, a text image, a text string image, a moving image, video, and dynamic visual effect.

15. The inflatable display device of claim 7, wherein the plurality of illumination sources form a lighted three dimensional structure.

16. The inflatable display device of claim 7, wherein the plurality of illumination sources are electrically coupled to each other.

17. An inflatable display device comprising:

an inflatable support device including a cast silicone material;

a plurality of illumination sources, each of the illumination sources secured to a surface of the inflatable support device; and a control system coupled to the illumination sources;

wherein each of the illumination sources is positioned between an interior surface and an exterior surface of the inflatable support device;

wherein the control system coordinates operation of the plurality of illumination sources to form the appearance of a continuous display.

18. The inflatable display device of claim 17, wherein the control system coordinates the operation of each illumination source individually.

19. The inflatable display device of claim 17, wherein the inflatable display device produces a plurality of images.

20. The inflatable display device of claim 17, wherein the illumination sources comprise flexible light emitting diodes.

21. The inflatable display device of claim 20, wherein the flexible light emitting diodes produce a plurality of colors.

22. The inflatable display device of claim 20, wherein the flexible light emitting diode illumination sources are movable relative to each other.

23. The inflatable display device of claim 17, wherein inflating the inflatable display device forms a predetermined three dimensional structure.

24. The inflatable display device of claim 17, comprising deflating the inflatable display device to decrease a size of the inflatable display device.

25. The inflatable display device of claim 17, wherein the plurality of illumination sources remain secured to the deflated inflatable display device.

26. The inflatable display device of claim 17, wherein the continuous display provides a continuous image selected from the group consisting of, a three-dimensional image, a landscape image, a portrait image, a text image, a text string image, a moving image, video, and dynamic visual effect.

27. The inflatable display device of claim 17, wherein the plurality of illumination sources form a lighted three dimensional structure.

28. The inflatable display device of claim 17, wherein the plurality of illumination sources are electrically coupled to each other.

* * * * *